US008601775B1

(12) United States Patent
Rowley et al.

(10) Patent No.: US 8,601,775 B1
(45) Date of Patent: Dec. 10, 2013

(54) DUNNAGE-FREE SHIPPING ASSEMBLY

(75) Inventors: Peter D. Rowley, Sammamish, WA (US); Ira C. Smith, Cincinnati, OH (US); Suzanne C. Reynolds, Lexington, KY (US); Althea J. D'Souza, Bellevue, WA (US); Mackenzie Smith, Issaquah, WA (US)

(73) Assignee: Amazon Technologies, Inc., Reno, NV (US)

( * ) Notice: Subject to any disclaimer, the term of this patent is extended or adjusted under 35 U.S.C. 154(b) by 1240 days.

(21) Appl. No.: 12/276,841

(22) Filed: Nov. 24, 2008

Related U.S. Application Data

(62) Division of application No. 10/836,640, filed on Apr. 30, 2004, now Pat. No. 7,469,786.

(51) Int. Cl.
*B65B 23/00* (2006.01)
*B65B 43/26* (2006.01)

(52) U.S. Cl.
USPC ..... 53/472

(58) Field of Classification Search
USPC ..... 53/472, 419, 467, 477, 381.1, 382.1
See application file for complete search history.

(56) References Cited

U.S. PATENT DOCUMENTS

| | | | | |
|---|---|---|---|---|
| 3,385,424 | A | 5/1968 | Thompson et al. | |
| 3,598,233 | A | 8/1971 | Jasinover | |
| 4,852,743 | A | 8/1989 | Ridgeway | |
| 4,923,065 | A | 5/1990 | Ridgeway | |
| 5,071,009 | A | 12/1991 | Ridgeway | |
| 5,251,760 | A | 10/1993 | Smith et al. | |
| 5,261,208 | A * | 11/1993 | Lockhart | 53/398 |
| 5,287,968 | A | 2/1994 | Ridgeway | |
| 5,323,896 | A * | 6/1994 | Jones | 206/223 |
| 5,388,701 | A | 2/1995 | Ridgeway | |
| 5,568,750 | A * | 10/1996 | Galen | 81/3.49 |
| 5,678,695 | A | 10/1997 | Ridgeway | |
| 5,725,119 | A | 3/1998 | Bradford et al. | |
| 5,893,462 | A | 4/1999 | Ridgeway | |
| 5,996,804 | A | 12/1999 | Kuhn et al. | |
| 6,010,006 | A | 1/2000 | Ridgeway | |
| 6,053,346 | A | 4/2000 | Niles et al. | |
| 6,062,410 | A | 5/2000 | Bradford et al. | |
| 6,148,590 | A | 11/2000 | Ridgeway | |
| 6,148,591 | A | 11/2000 | Ridgeway | |
| 6,216,871 | B1 | 4/2001 | Bacques et al. | |
| 6,230,916 | B1 | 5/2001 | Bradford et al. | |
| 6,460,703 | B1 | 10/2002 | Thompson et al. | |
| 6,578,346 | B1 * | 6/2003 | Sowa | 53/399 |

* cited by examiner

*Primary Examiner* — Alexandra Elve
*Assistant Examiner* — John Paradiso
(74) *Attorney, Agent, or Firm* — Robert C. Kowert; Meyertons, Hood, Kivlin, Kowert & Goetzel, P.C.

(57) ABSTRACT

A dunnage-free product-shipping assembly comprising a support member securable to the product in a substantially fixed position. A shipping container has an interior area sized to removably contain the support member. The shipping container has a base and sidewalls projecting from the base. The sidewalls restrict lateral movement of the support member relative to the base. A closure member is movable between an open position and a closed position. The closure member is out of engagement with the support member and the product when in the closed position. A retention flap is connected to one of the sidewalls and is movable between engaged and released positions. The retention flap, when in the engaged position, restricts movement of the support member and the product in a direction normal to the base. When the retention flap is in the released position, the support member and product can be moved normally relative to the base for removal from the shipping container.

10 Claims, 6 Drawing Sheets

DUNNAGE-FREE SHIPPING ASSEMBLY

This application is a divisional of U.S. patent application Ser. No. 10/836,640, filed on Apr. 30, 2004.

TECHNICAL FIELD

The present invention is directed to apparatus and methods for packing and shipping of products without requiring dunnage in the shipping container for safe transport.

BACKGROUND

Consumer and retail products are often packed and shipped directly to consumers or retailers using conventional shipping boxes. The shipping boxes typically include protective packing material in the shipping box to protect the products against shipping and handling hazards. The protective packing material is often crumpled paper, liners, plastic air pillows, bubble-wrap, Styrofoam, compressible foam "peanuts," or other dunnage. The dunnage can effectively immobilize the products within the shipping box and can absorb external loads to protect the products. The dunnage, however, can be difficult to handle and labor-intensive when packing a box, thereby adding to the cost of shipping the products. The dunnage also results in excessive waste material that can be messy, bothersome, and difficult to dispose of after the products are removed from the shipping box.

Other conventional packaging systems include specially shaped restraints designed to immobilize the product within the shipping box. The specially shaped restraints can be created by molding or pre-forming the restraint structure so as to fully or partially enclose the product when packed. These restraints, however, are specially shaped to correspond to the particular products, so that each specially shaped restraint is limited to use with only products of certain shapes and sizes. Creating specially shaped restraints for large numbers of consumer products having different shapes could be cost-prohibitive. In addition, the packaging of products in such specially shaped restraints can be very labor-intensive, thereby adding to the cost of shipping.

Another approach to protecting products during shipping is known as suspension packing. An object to be shipped is suspended between two sheets of plastic film material in a face-to-face relationship. The sheets are usually attached to frames that fit securely within a box of a selected size. Accordingly, the product does not contact any substantially rigid surfaces within the box and is protected from physical shock. Examples of suspension packing systems are disclosed in U.S. Pat. Nos. 4,852,743; 4,923,065; 5,071,009; 5,388,701; 5,287,968; and 5,678,695.

Other packaging systems immobilize a product on a frame structure that fits within the shipping box. The frames are shaped and sized to engage the top, bottom, and sides of the shipping box, so there is a minimum amount of movement of the frame within the shipping box. Examples of frame packing systems are disclosed in U.S. Pat. Nos. 5,678,695; 5,893,462; 6,010,006; 6,148,590; and 6,148,591. The suspension packing systems and frame packing systems can be effective at protecting the products being shipped, although the systems can be fairly complex, and expensive. The systems can also be labor-intensive, particularly when shipping products of all shapes and sizes in large volumes and in multiple shipping boxes of different sizes. Accordingly, there is a need for an easy, inexpensive packing and shipping system that securely immobilizes and protects the products and that minimizes the amount of waste that must be disposed of by the recipient.

SUMMARY

The present invention is directed to apparatus and methods for dunnage-free packing and shipping of products. Under one aspect of the invention, a product-shipping assembly comprises a support member securable to the product with the product being in a substantially fixed position relative to the support member. The assembly has a shipping container with an interior area sized to removably contain the support member when the product is secured to the support member.

The shipping container comprises a base and sidewalls projecting from the base. The support member is shaped and sized so the sidewalls restrict lateral movement of the support member relative to the base when the support member is in the interior area. A closure member is movable relative to the sidewalls between an open position and a closed position. The closure member is out of engagement with the support member and the product when in the closed position.

A retention flap is connected to one of the sidewalls and is movable relative to the sidewall between an engaged position and a released position. The retention flap, when in the engaged position, is spaced apart from the base and is engagable with an edge portion of the support member to restrict movement of the support member in a direction normal to the base. In the released position, a free edge of the retention flap is spaced apart from the edge portion of the support member, allowing movement of the support member and removal from the interior area of the shipping container.

Under another aspect of the invention, a method is provided for packing a product for shipping. The method of one embodiment comprises securing the product on a support member with an edge portion of the support member projecting beyond the product. The product is substantially restricted from moving relative to the support member. The product and the support member define a product unit.

The product unit is positioned into a shipping container. The container has a base, sidewalls connected to the base, a retention flap connected to a first sidewall, and a closure member movable between an open position and a closed position. The retention flap is positionable within the interior area and movable between a released position and an engaged position. The retention flap is moved to the released position as the product unit is positioned into the interior area. The product unit is positioned in a packed position with the support member substantially adjacent to the base. The product unit is restricted by the sidewalls from moving laterally relative to the base when the product unit is in the packed position. The retention flap is moved to the engaged position after the product unit is in the packed position. The retention flap is immediately adjacent to the edge portion of the support member and restricted from moving normally relative to the base.

DETAILED DESCRIPTION

The present disclosure describes product packing and shipping components, systems, and methods. Several specific embodiments are set forth in the following description and in FIGS. 1-8 to provide a thorough understanding of certain embodiments of the invention. One skilled in the art, however, will understand that the present invention may have additional embodiments, and that other embodiments of the invention may be practiced without several of the specific features explained in the following descriptions.

Figure 1:
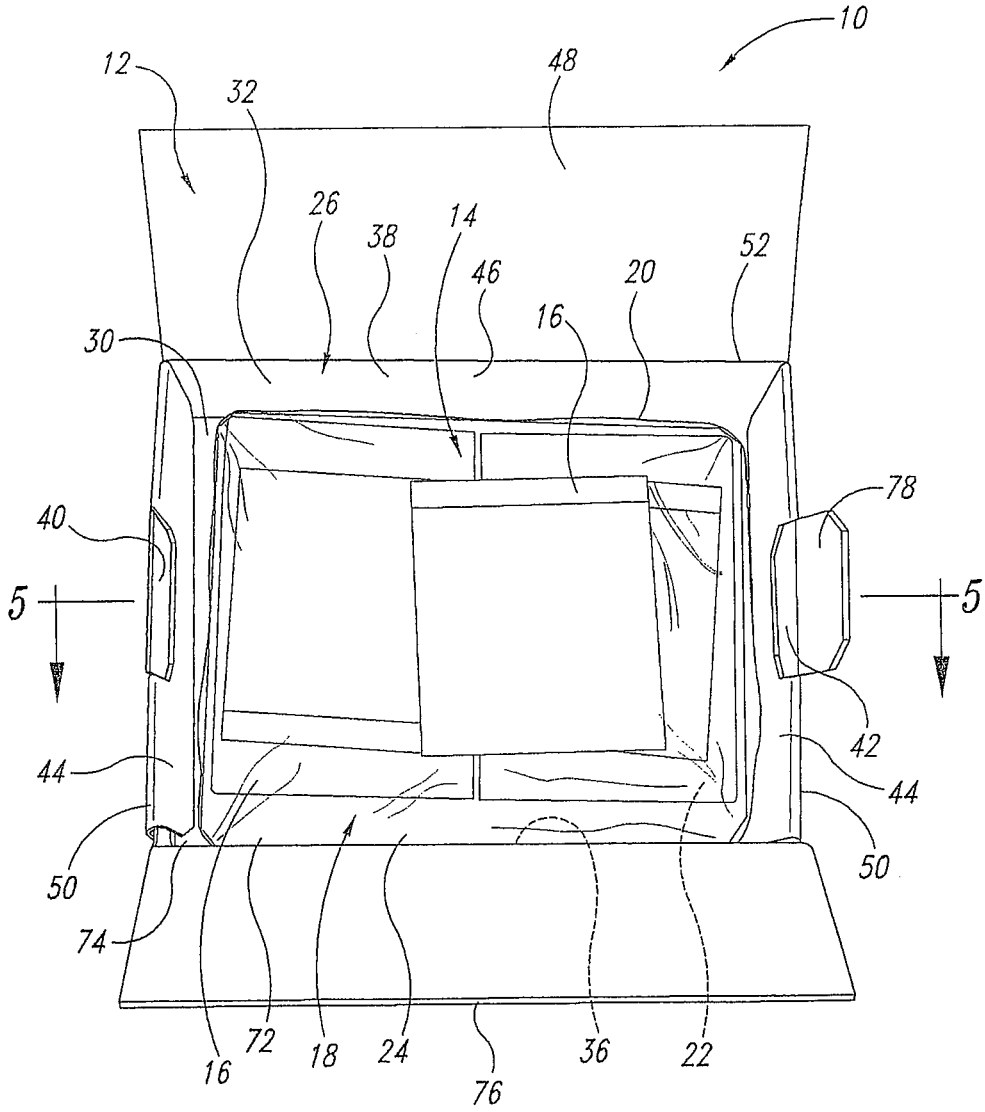
FIG. 1 is an isometric view of a dunnage-free shipping assembly with a shipping box and product unit contained therein in accordance with one embodiment of the present invention.
Figure 2:
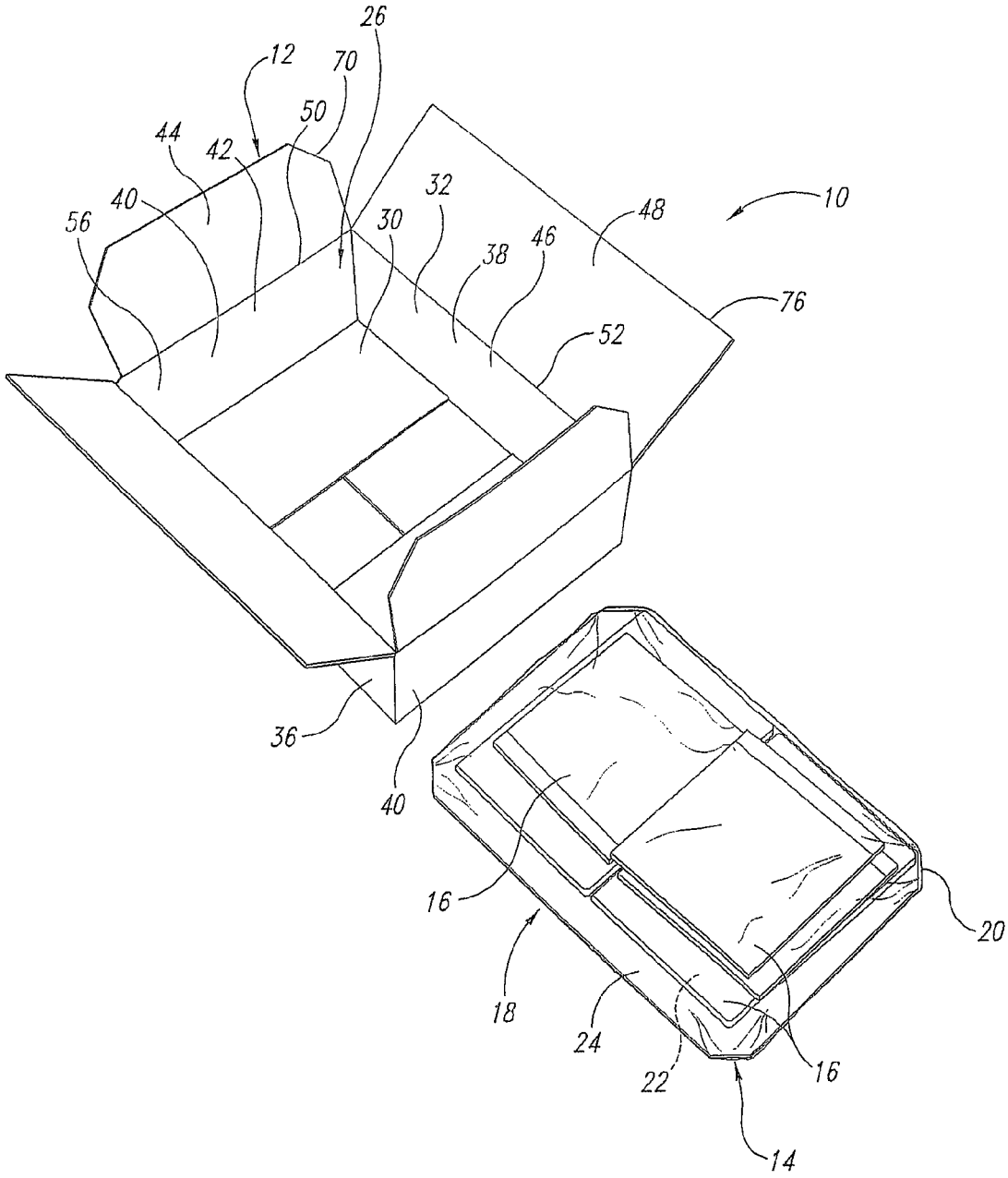
FIG. 2 is an isometric view of the shipping assembly of FIG. 1 with a product unit shown removed from the shipping box.

FIG. 1 is a top isometric view of a product shipping system 10 in accordance with one embodiment of the present invention. The system 10 includes a shipping box 12 configured to releasably retain and immobilize a product unit 14, which includes one or more products 16 secured to a support member 18. FIG. 2 is a top isometric view of the system 10 of FIG. 1 with the product unit 14 shown removed from the shipping box 12. The system 10 allows for one or more products 16 to be packed into the shipping box 12 in an immobilized position within the shipping box, thereby eliminating the need for excess packing material, such as air pillows, foam inserts, crushed paper, or other dunnage. Accordingly, the system 10 is dunnage-free and allows for efficient and inexpensive shipping of products 16.

In the illustrated embodiment, the product unit 14 includes multiple products 16 releasably secured to a substantially rigid support member 18. In other embodiments, a single product 16 can be secured to the support member 18. The support member 18 is a flat sheet of rigid, corrugated cardboard shaped and sized to closely fit within the interior length and width of the shipping box 12. In other embodiments, the support member 18 can be made of other rigid or semi-rigid materials suitable for restricting movement of the product unit 14 within the shipping box, as discussed in greater detail below.

The products 16 are substantially immobilized on the support member 18 by a wrapping material 20 that fully or partially encases the products and the support member. In the illustrated embodiment, the wrapping material 20 is a shrink wrap film that encases the products 16 and the support member 18 upon being heated to a selected temperature that will not damage the products. In other embodiments, other wrapping material 20 could be used to hold the products 16 on the support member 18. In yet other embodiments, other securing materials or mechanisms can be used to releasably secure the products 16 onto the support member 18.

After the products 16 are secured to the support member 18 in some embodiments, the products may be able to slide laterally a small distance relative to each other or relative to the support member. But, the products 16 are securely retained so they will not impact the sides of the shipping box 12 as a result of loads from handling and shipping of the shipping box.

Figure 3:
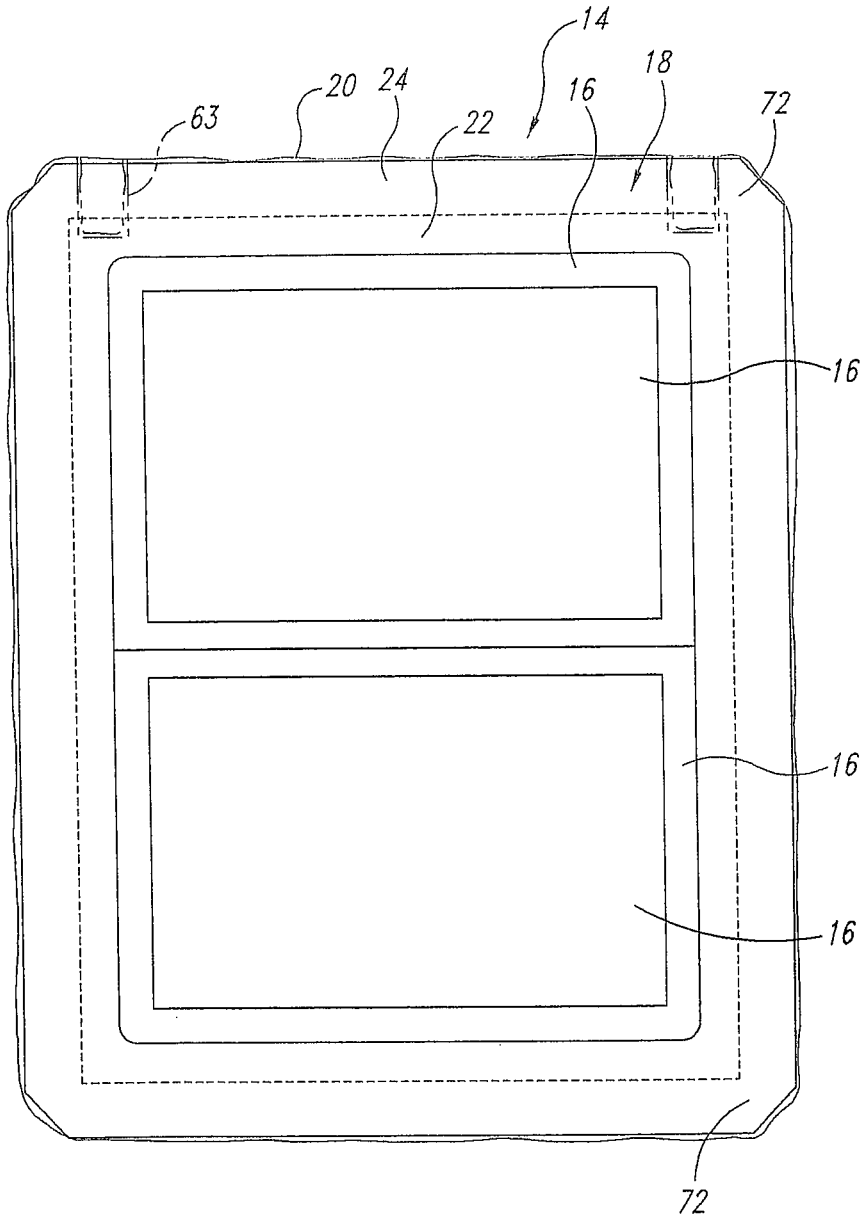
FIG. 3 is an enlarged top plan view of the product unit of FIG. 1 shown removed from the shipping box.

FIG. 3 is an enlarged top plan view of the support member 18 having the products 16 held in place with the wrapping material 20. The support member 18 has a peripheral edge portion 24 that extends around a central support portion 22. The products 16 are positioned on the central support portion 22 so the peripheral edge portion 24 projects laterally beyond the products. In one embodiment, if any of products 16 are positioned to cover the peripheral edge portion 24, the products are repositioned to expose the peripheral edge portion. If the products 16 are too large to fit within the boundaries of the central support portion 22, then a larger support member 18 and shipping box 12 are used to ship the product unit 14. Accordingly, when the products 16 are secured to the support member 18, the peripheral edge portion 24 may be covered by the wrapping material 20 but is engagable by the shipping box to restrict lateral movement of the product unit 14, as discussed in greater detail below.

As best seen in FIGS. 1 and 2, the support member 18 is shaped and sized with a specific length and width that substantially correspond to the length and width of the interior area 26 of the shipping box 12. The shipping box 12 of the illustrated embodiment has a base 30 connected to a plurality of sidewalls 32 to define the interior area 26. The shipping box 12 of the illustrated embodiment is made of a substantially rigid, corrugated cardboard die-cut and folded to provide the base 30 and the sidewalls 32.

The sidewalls 32 include opposing left and right side panels 36 and 38 and a pair of opposing end panels 40 extending between the left and right side panels. The left and right side panels 36 and 38 are spaced apart by a distance slightly greater than the width of the support member 18. The end panels 40 are spaced apart by a distance slightly greater than the length of the support member 18. In one embodiment, the distance between the end panels 40 is greater than the length of the support member 18 by a distance substantially corresponding approximately to the thickness of the cardboard forming the shipping box 12.

When the support member 18 is placed into the interior area 26, the peripheral edge portion 24 is substantially adjacent to sidewalls 32 of the shipping box 12. Accordingly, the support member 18 is substantially restricted from lateral movement within the shipping box 12. Because the support member 18 does not move laterally within the shipping box 12, the products 16 secured to the support member are also restricted from moving laterally within the shipping box.

Figure 4:
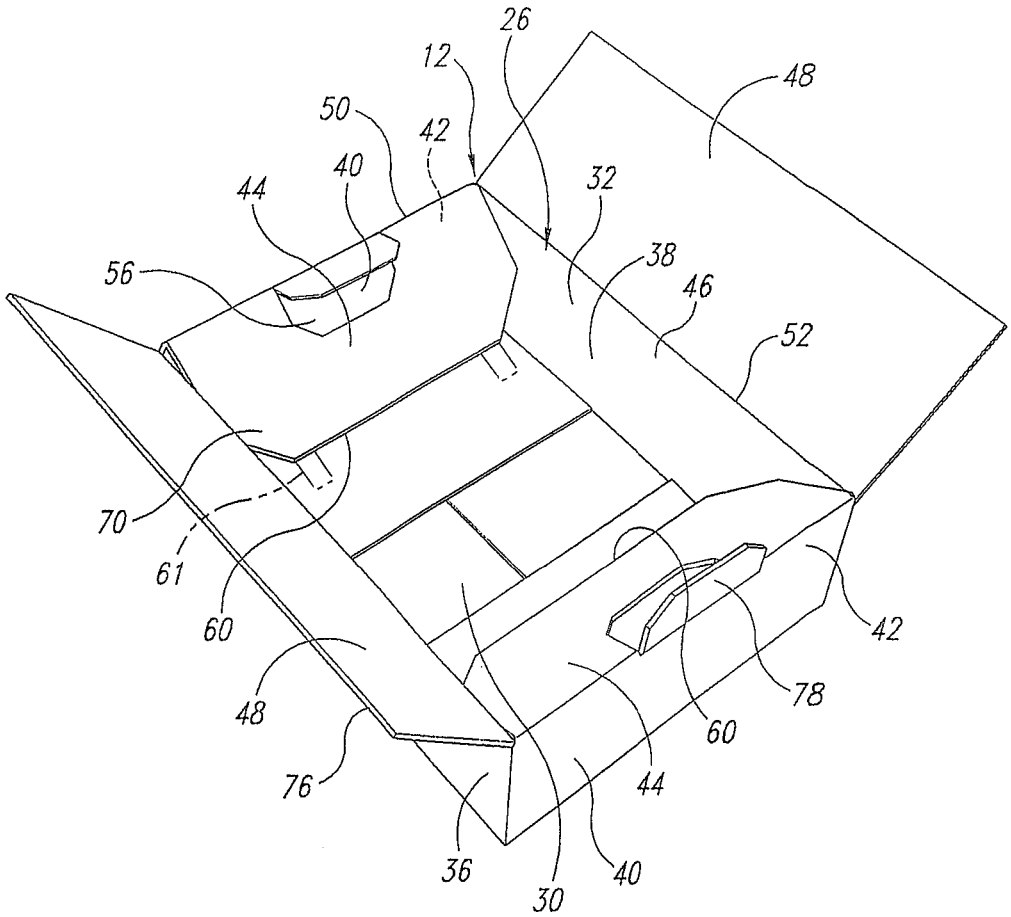
FIG. 4 is an isometric view of the shipping box of FIG. 1 with major flaps shown in an open position and minor flaps shown in an inwardly folded position.

While the close fit between the sidewalls 32 and the support member 18 restricts lateral movement of the product unit 14, the sidewalls do not substantially restrict movement of the product unit in a direction normal to the base 30. This movement of the product unit 14 normal to the base 30 is restricted by flaps on the shipping box 12. Upper portions 42 of the end panels 40 are integrally connected to a pair of minor flaps 44. Upper portions 46 of the left and right side panels 36 and 38 are integrally connected to a pair of closure flaps referred to as major flaps 48. Each of the minor flaps 44 is pivotable about a hingeline 50 at the upper portion 42 of the respective end panel 40. The minor flaps 44 can fold into the interior area 26 of the shipping box 12, as shown in FIG. 4, before the product unit 14 is placed into the interior area. Each of the major flaps 48 is pivotable about a hingeline 52 at the upper portion 46 of the respective left and right side panels 36 and 38. The major flaps 48 can move between an open position (FIG. 2) and a closed position (FIG. 8) to cover the interior area 26 and the product unit 14 within the shipping box 12.

The product unit 14 is securely held down within the shipping box's interior area 26 by the minor flaps 44. Prior to placing the product unit 14 into the shipping box 12, the minor flaps 44 are positioned in an inwardly folded position, as shown in FIG. 4. The minor flaps 44 are biased away from the end panels 40 toward the inwardly folded position. The minor flaps 44 can be pivoted about the hingeline 50 to a released position, so the minor flaps are substantially flush against the inner surface 56 of the respective end panel. When the minor flaps 44 are released, the minor flaps will seek to move away from the released position toward the inwardly folded position.

Figure 5:
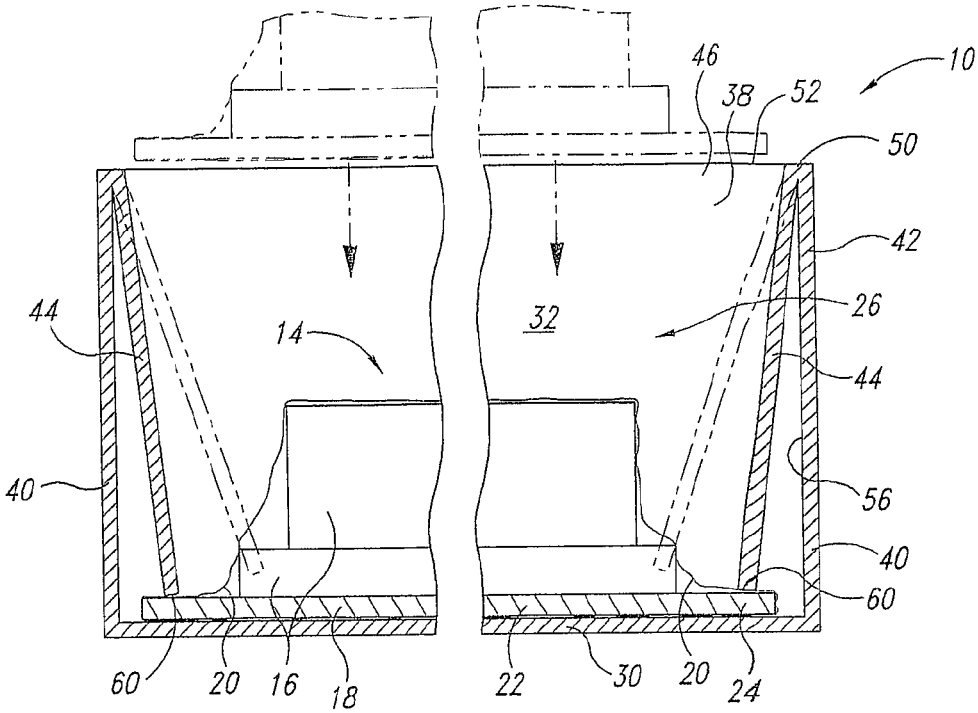
FIG. 5 is an enlarged cross-sectional view taken substantially along line 5-5 of FIG. 1 showing the minor flaps in an engaged position securely retaining the product unit within the shipping box.

FIG. 5 is an enlarged cross-sectional view taken substantially along line 5-5 of FIG. 1 showing the product unit 14 securely retained in the shipping box 12. The minor flaps 44 have a height that is shorter than the height of the end panel 40. Accordingly, when the minor flap 44 is folded into the interior area 26 and positioned generally adjacent to the inner surface 56 of the end panel 40, a free edge 60 of the minor flap is spaced above the base by a selected distance. In the illustrated embodiment, the distance between the minor flap's free edge 60 and the base 30 is slightly greater than the thickness of the support member 18.

When the product unit 14 is placed into the interior area 26 of the shipping box 12 substantially flush against the base 30, the peripheral edge portion 24 of the support member 18 is located in the space between the base and the free edge 60 of the minor flap 44. When the minor flaps 44 are in an engaged position, as shown in FIG. 5 in solid lines, the free edges 60 of the minor flaps are positioned immediately above the product unit 14 at the peripheral edge portion 24. In one embodiment, the free edges 60 of the minor flaps 44 frictionally engage the product unit 14 at the peripheral edge portion 24. Accordingly, the minor flaps 44 releasably lock the product unit 14 down in place within the shipping box 12 and prevent the product unit from moving in a direction normal to the base 30. The products 16 in the shipping box 12, therefore, are substantially immobilized from lateral and normal movement relative to the base 30.

In the illustrated embodiment, the support member 18 is positioned flush against the base 30 of the shipping box 12. In other embodiments, the support member 18 can be shaped so a portion of the support member is supported on the base 30 and the peripheral edge portion 24 is spaced a selected distance above the base. The minor flaps 44 in this other embodiment are shaped and sized so their height substantially corresponds to the distance between the peripheral edge portion 24 and the hingeline 50 of the minor flaps 44. The minor flaps 44 are positionable in the engaged position immediately above the peripheral edge portion 24, so the product unit 14 is secured in place and restricted from normal and lateral movement relative to the base 30.

As best seen in FIG. 5, when the product unit 14 is to be placed into the interior area 26 of the shipping box 12 and secured in place, the minor flaps 44 are initially in the inwardly, folded position shown in phantom lines. The product unit 14 with the products 16 therein is locked into place within the shipping box 12 simply by pressing the product unit downwardly in the interior area 26. The peripheral edge portions 24 of the support member 18 press against the minor flaps 44, and the minor flaps pivot about the hingelines 50 and move to a released position, shown in FIG. 6. The minor flaps 44, when in the released position, are immediately adjacent to the inner surface 56 of the end panels 40.

After the product unit 14 is pressed downwardly fully into the interior area 26 with the support member 18 substantially flush against the base 30, the peripheral edge portion 24 of the support member is below the free edges 60 of the minor flaps 44. The minor flaps 44, which are biased toward the inwardly, folded position, pivot a short distance inwardly to an engaged position, so the free edges 60 are directly over the peripheral edge portions 24. Accordingly, the minor flaps 44 automatically lock the product unit 14 in the interior area 26 until released. This automatic locking of the product unit 14 in place allows for fast, efficient packing of the shipping box 12 with a minimum amount of labor required.

The product unit 14 remains locked in place in the shipping box 12 so the products 16 substantially do not move relative to the shipping box while the shipping box is in transit. Accordingly, the products 16 are protected from damage due to loads that may be exerted on the shipping box during handling and shipping. In one embodiment, a shock absorptive layer can be provided between the support member 18 and the base 30 to help reduce impact loads to the products 16 if, as an example, the shipping box 12 is dropped and lands flat on its base 30.

Figure 6:
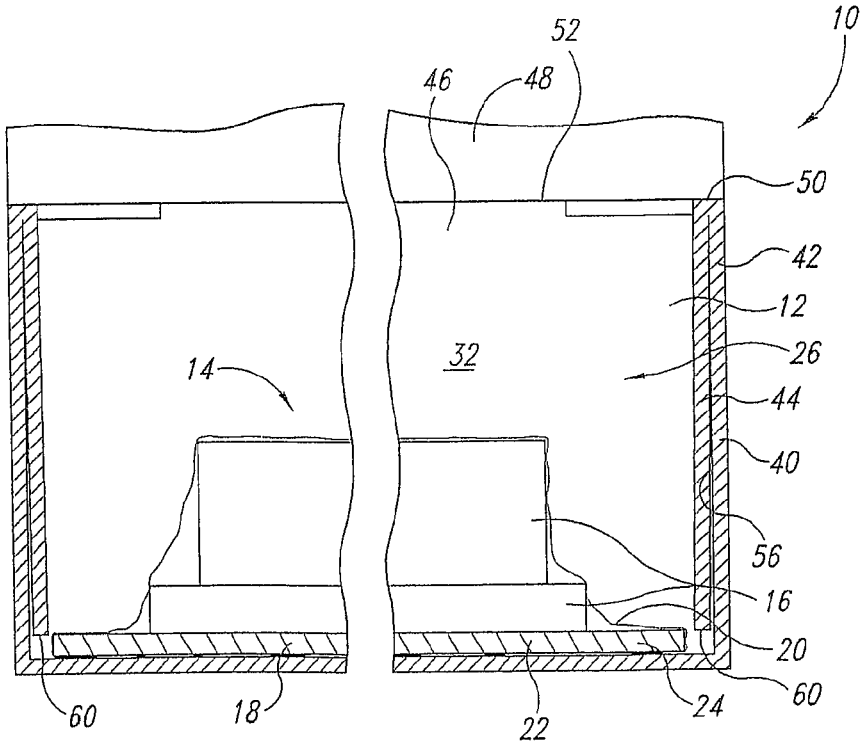
FIG. 6 is an enlarged cross-sectional view similar to FIG. 5 showing the minor flaps in a released position for removal of the product unit from the shipping box.

The product unit 14 can easily and quickly be released from the shipping box 12 by pressing the minor flaps 44 outwardly from the engaged position, shown in FIG. 5, to the released position, shown in FIG. 6. In the released position, the free edges 60 of the minor flaps 44 are spaced laterally apart from the peripheral edge portion 24 of the support member 18. Accordingly, the minor flaps 44 no longer block the product unit 14 from moving in a direction normal to the base 30. The product unit 14 can then be easily lifted out of the shipping box's interior area 26. The wrapping material 20 can then be removed from the support member 18 to get to the products 16. In one embodiment, the wrapping material 20 can be cut or otherwise opened while the product unit 14 remains in the shipping box 12, so the products 16 could be removed without having to remove the entire product unit. As indicated above, the shipping box 12 and the support member 18 are made of cardboard, which can be recycled. In one embodiment, the wrapping material 20 can also be a recyclable material, such as paper. After the products 16 are removed from the shipping box 12 in this embodiment, the remaining components of the system 10 could all be recycled.

In one embodiment, the minor flaps 44 each have one or more alignment tab 61 (shown in phantom lines in FIG. 4) extending from the free edge 60. The tab 61 extends substantially to the base 30 and is integrally connected to the free edge 60. The tab 61 can be provided as an alignment member for use in the manufacturing of the shipping box 12. As an example, when shipping boxes 12 are die cut and stacked in a flat configuration, the tabs 61 can help align the flat, stacked shipping boxes in a desired position for subsequent automated processing of the shipping boxes.

In this embodiment with the tab 61, the support member 18 is provided with a matching notch 63 (shown in phantom lines in FIG. 3). The notch 63 is positioned and sized to receive the tab 61 therein when the minor flap 44 is in the engaged position. Accordingly, the tab 61 (FIG. 4) does not block the minor flap 44 from moving to the engaged position from the released position. The tab 61, however, can act as a stop that helps block the minor flap 44 from moving past the engaged position away from the end panel 56.

In another embodiment, the minor flaps 44 each have an alignment tab 61 extending from the free edge 60, and a cut is formed in the minor flap adjacent to the flap. The cut allows the tab 61 and a flex portion of the minor flap remain substantially in the released position when the rest of the minor flap moves to the engaged position. The free end of the tab 61 in one embodiment has a perforated hinge line about which the tab can partially fold to accommodate the edge of the support member 19 when positioned in the shipping box adjacent to the base. Accordingly, the support member 18 does not need a notch to receive the tab 61. When the support member 18 is placed into the shipping box 12 adjacent to the base 30, the support member 19 presses against the tab 61 and holds the tab and the flex portion of the minor flap 44 next to the end panel. The remainder of the minor flap 44 is in the engaged position to securely retain the support member 19 in the interior area 26 of the shipping box 12.

As best seen in FIG. 4, corner areas 70 of the minor flaps 44 are beveled so they do not have a sharp point at the ends of the free edges 60. The beveled corner areas 70 do not damage the wrapping material 20 or other retention member that holds the products 16 on the support member 18. The beveled corner areas 70 also help prevent the minor flap 44 from hanging up on the wrapping material 20 before reaching the engaged position. In other embodiments, the corner areas 70 are rounded or have other shapes to help ensure that the minor flaps 44 will properly move between the released and engaged positions.

As best seen in FIGS. 1 and 3, the support member 18 also has beveled or otherwise shaped corner portions 72 positioned adjacent to an end panel 40 and the left or right side panel 36 or 38. The beveled corner portions 72 provide an access area 74 adjacent to the edge of the support member 18. The access area 74 is sized so a person can place a finger into it, engage the support member 18, and lift the product unit 14 upwardly away from the base 30 after the minor flaps 44 have been moved to the released position. In other embodiments, other features can be provided on the support member 18 that allow a user to grasp or engage the support member to facilitate removal of the product unit 14 from the shipping box 12 when the minor flaps 44 are in the released position.

Figure 7:
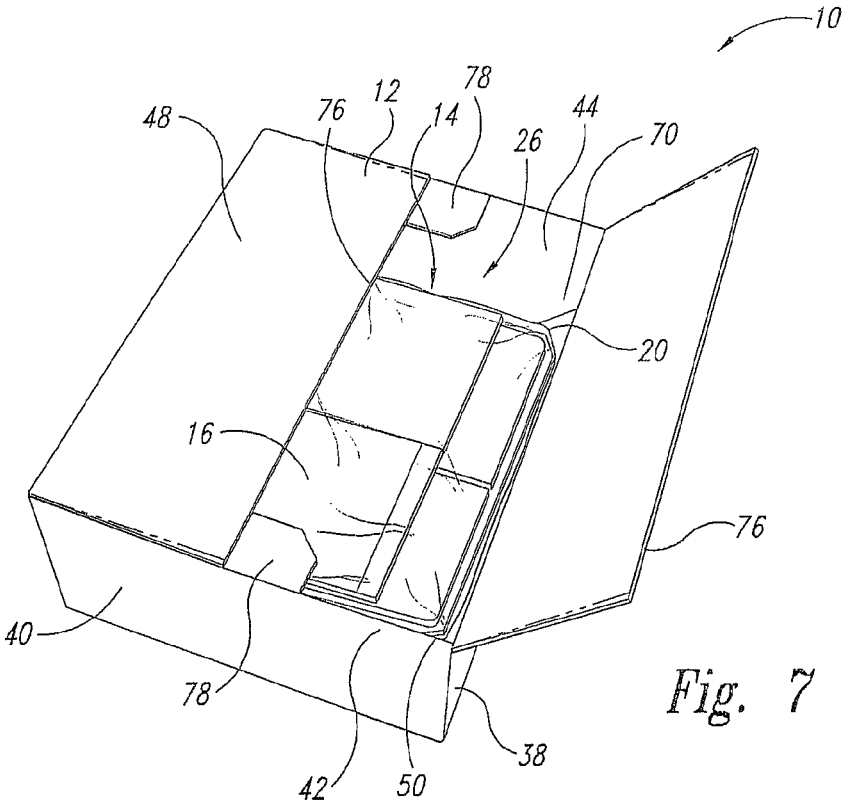
FIG. 7 is an isometric view of a shipping box in accordance with one embodiment having support tabs on endwalls of the shipping box.
Figure 8:
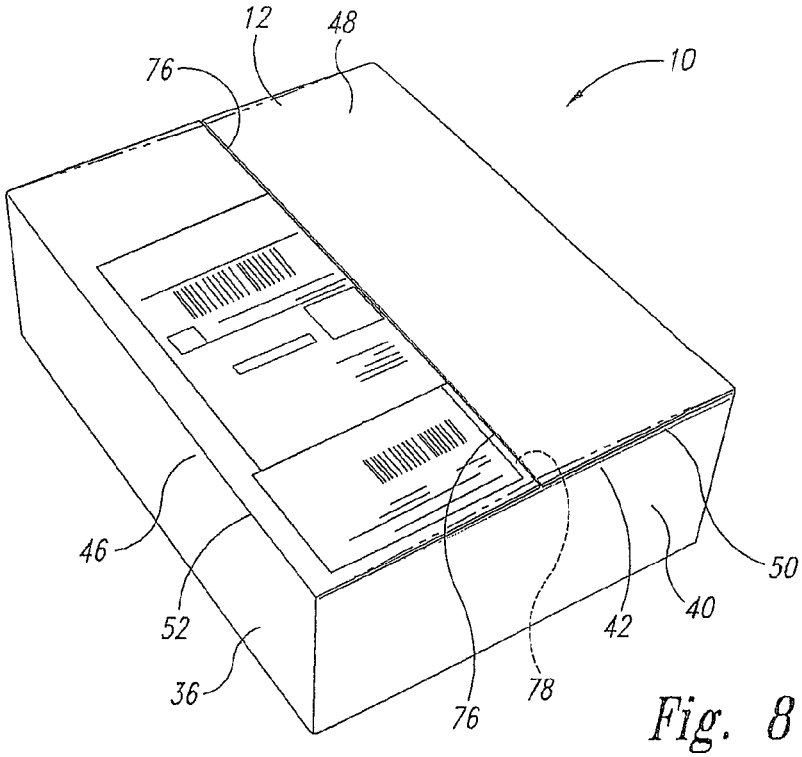
FIG. 8 is an enlarged isometric view of the shipping box of FIG. 7 in the closed configuration ready to be shipped.

FIG. 7 is an isometric view of the shipping box 12 containing the product unit 14, and one of the major flaps 48 is shown in a closed position. The other major flap 48 is shown in the open position. In the illustrated embodiment, the product unit 14 is placed into the interior area 26 of the shipping box 12 when the major flaps 48 are in the open position. When the major flaps 48 are in the closed position, as shown in FIG. 8, the major flaps 48 cover the interior area 26.

In the illustrated embodiment, the major flaps 48 have a height corresponding to approximately one-half of the width of the interior area, so the two major flaps abut each other when closed. The height of each major flap 48 is greater than the height of each minor flap 44. In other embodiments wherein the shipping box has a very deep interior area, the height of the minor flaps 44 may be greater than the height of the major flaps 48. In yet other embodiments, a single major flap 48 may be used to cover the interior area 26 and close the shipping box 12, while the minor flaps 44 releasably lock the product unit within the interior area, as discussed above.

As best seen in the FIG. 7, when the major flaps 48 are in the closed position, edges 76 of the major flaps are adjacent to the upper edge portions 42 of the end panels 40. The major flap 48 can be shaped so the edges 76 are substantially parallel with the end panels 40. In other embodiments, all or portions of the edges 76 of the major flap 48 can be formed at an angle relative to the end panels 40, so portions of the major flap generally adjacent to the hingeline 52 extend over and rest atop the end panels 40. Accordingly, each major flap 48 is at least partially supported by the end panels 40 when in the closed position. When the major flaps 48 are in the closed position, the angled portions of the edges form a recessed portion (shown in phantom lines in FIGS. 7 and 8). The recessed portion is shaped and sized to receive shipping tape applied to the shipping box 12. The recess allows the shipping tape to smoothly transition over the edges 76 of the major flaps 48 to the end panels 40 without gapping. The recess also helps to prevent the shipping tape from peeling breaking or being cut by the edges 76 of the major flaps.

In the illustrated embodiment of FIG. 7, the shipping box 12 has a pair of support tabs 78 integrally connected to the upper portions 42 of the end panels 40. The support tabs 78 support the major flaps 48 along at least a portion of the edges 76. In the illustrated embodiment, the support tabs 78 are formed by a die cut made in the minor flaps 44, so the support tabs extend inwardly from the hingelines 50 of the end panels 40.

The support tabs 78 provide a surface on which a portion of the major flaps 48 can rest when in the closed position and when the minor flaps 44 are in the engaged position. The support tabs 78 block the major flaps 48 from moving past the closed position and into the interior area 26 of the shipping box 12. The support tabs 78 also provide a structure at the intersection of the major flaps 48 and the end panels 40 that restricts visibility into the interior area 26 of the shipping box 12. For example, if some gapping occurs between the major flaps 48 and the end panels 40 when the major flaps are secured in the closed position, the support tabs 78 block visibility into the shipping box 12, thereby maintaining a level of privacy as to the contents in the shipping box 12. In the illustrated embodiment, one support tab 78 is provided on each end panel 40. In other embodiments, more than one support tab 78 can be provided along each of the end panels 40 as needed to support the major flaps 48 when in the closed position.

From the foregoing, it will be appreciated that specific embodiments of the invention have been described herein for purposes of illustration, but that various modifications may be made without deviating from the spirit and scope of the invention. For example, in one embodiment, the shipping box 12 may be made from a unitary sheet of cardboard, die-cut, and folded. In another embodiment, the shipping box 12 may be made from a plurality of panel portions connected and glued or otherwise adhered together. The support member 18 can be a shaped frame structure or, in other embodiments, a planar structure that supports the products 16 in the central support portion 22 radially inward from the peripheral edge portion 24. In other embodiments, the support member 18 can have peripheral edge tabs extending from the support member engagable with the minor flaps 44 when the minor flaps are in the engaged position. Accordingly, the invention is not limited except as by the appended claims.

We claim:

1. A method of packing a product for shipping, comprising:

securing the product on a support member with an edge portion of the support member projecting beyond the product, the product being substantially restricted from moving relative to the support member, the product and the support member defining a product unit;

positioning the product unit into a shipping container having a base, sidewalls connected to the base, a retention flap connected to a first sidewall, and a closure member movable between an open position and a closed position substantially covering an interior area of the shipping container, the retention flap being positionable within the interior area and movable between a released position within the interior area and an engaged position within the interior area;

moving the retention flap such that the retention flap is in the released position as the product unit is positioned in the interior area;

positioning the product unit in a packed position within the interior area with the support member substantially adjacent to the base;

restricting movement of the product unit laterally relative to the base with the sidewalls when the product unit is in the packed position;

moving the retention flap from the released position to the engaged position while the product unit is in the packed position such that a free edge of the retention flap is immediately adjacent to the edge portion of the support member; and utilizing the free edge of the retention flap to restrict the product unit from moving normally relative to the base while the product unit is in the packed position and while the retention flap is in the engaged position.

2. The method of claim 1, further comprising securing the closure member in the closed position without adding dunnage into the interior area adjacent to the product unit.

3. The method of claim 1, further comprising moving the closure member to the closed position after the product unit is restricted from movement laterally and normally relative to the base, with the closure member being out of engagement with the product unit.

4. The method of claim 1, further comprising moving the closure member to the open position, moving the retention flap to the released position, and removing the product unit from the interior area of the shipping container.

5. The method of claim 1, further comprising moving the closure member to the closed position after the product unit is in the packed position, and supporting the closure member with a support tab coupled to the first sidewall adjacent to the retention flap.

6. The method of claim 1 wherein securing the product on the support member includes providing a plastic film around at least a portion of the support member and the product.

7. The method of claim 1 wherein securing the product on the support member includes providing a plastic film around at least a portion of the support member and the product, and heat-shrinking the plastic film relative to the support member and the product.

8. The method of claim 1 wherein positioning the product unit in the packed position includes placing the shipping unit flush against the base of the shipping container.

9. The method of claim 1, further comprising urging the retention flap toward the engaged position when the product unit is in the packed position.

10. A method of making a shipping assembly for shipping a product, comprising:

forming a support member configured to receive a product to be secured thereon and having an edge portion, the support member having a first length, a first width, and a thickness; and forming a shipping container having a base and sidewalls connected to the base and positionable to define an interior area, the interior area having a second length greater than the first length and a second width greater than the first width, the interior area being sized to receive the support member therein with the sidewalls substantially restricting lateral movement of the support member relative to the base, the shipping container having at least one major flap connected to a first sidewall and at least one minor flap connected a second sidewall, the second sidewall having a height relative to the base, and the minor flap having a third height less than the height of the second sidewall by a distance substantially corresponding to the thickness of the support member, wherein the shipping container is formed such that: the minor flap is movable relative to the second sidewall between an engaged position within said interior area and a released position within said interior area, the minor flap is configured to be in the released position while the support member and product secured thereon are moved into the interior area of the shipping container, the minor flap is configured to be moved from the released position to the engaged position while the support member and product secured thereon remain within said interior area, a free edge of the minor flap is configured to be positioned restrict the support member and product secured thereon from moving normally relative to the base when the minor flap is in the engaged position.

* * * * *